US006904613B2

(12) United States Patent
Dotterer

(10) Patent No.: US 6,904,613 B2
(45) Date of Patent: Jun. 14, 2005

(54) NECKTIE ORNAMENT HOLDER

(76) Inventor: Ford K. Dotterer, 11B Phatsana Garden, 19 Sukhumvit 63, Ekkamai Soi 6, Bangkok (TH)

( * ) Notice: Subject to any disclaimer, the term of this patent is extended or adjusted under 35 U.S.C. 154(b) by 53 days.

(21) Appl. No.: 10/607,745

(22) Filed: Jun. 27, 2003

(65) Prior Publication Data

US 2004/0261154 A1 Dec. 30, 2004

(51) Int. Cl.[7] ..... A41D 25/16
(52) U.S. Cl. ..... 2/156; 24/49.1
(58) Field of Search ..... 2/144–151, 152.1, 2/153–156; 24/49.1, 66.1, 64, 65, 50, 51; 63/29.1, 33, 20

(56) References Cited

U.S. PATENT DOCUMENTS 580,578 A * 4/1897 Smith ..... 24/707.2
1,477,461 A * 12/1923 Smith ..... 24/707.5
1,887,104 A 11/1932 Roberts
2,444,548 A 7/1948 Wiebe
2,673,983 A 4/1954 Maginnis
4,173,793 A * 11/1979 Kazuo ..... 2/146
5,313,810 A * 5/1994 Koven ..... 63/33
5,416,925 A * 5/1995 Davis ..... 2/144

* cited by examiner

*Primary Examiner*—Tejash Patel
(74) *Attorney, Agent, or Firm*—David Kiewit

(57) ABSTRACT

A jewelry displaying arrangement uses a knot of a necktie as a support for a stone, medallion, or other article displayed on the necktie. This arrangement relies on a foundation shaped and sized as a stylized triangle or trapezoid so that it fits into the folds of the necktie knot. The foundation may be formed from a thin sheet of material having the surface shape of a necktie knot, and may have two or more legs extending upwardly from a base portion adjacent which the ornament, or other item to be displayed, is attached to the foundation. These legs provide the foundation with a wide enough upper end so as to prohibit the foundation from falling through the knot. The ornament may be attached to the foundation by any of a number of methods so that when the ornament holder is worn the ornament protrudes or drops below the knot into a visible position.

9 Claims, 2 Drawing Sheets

NECKTIE ORNAMENT HOLDER

BACKGROUND OF THE INVENTION

1. Field of the Invention

The invention relates to a jewelry displaying arrangement using a knot of a necktie as a support or holder for the stone, medallion, logo or other article displayed on the necktie.

2. Background Information

Ornaments, such as jewels, insignia charms and the like, are often displayed on a necktie. The most common arrangements for doing this involve either attaching the ornament to a tie bar used to secure the tie to a front of a wearer's shirt, or associating the ornament with a tie pin used to pin the front and rear panels of the knotted necktie together. In these cases the ornament is usually some twenty to thirty centimeters below the knot, where it is less visible than it would be if it were immediately adjacent the knot.

Approaches to displaying an ornament immediately adjacent a necktie knot or at the position of a knot are known in the haberdashery arts. Apparatus for this purpose commonly comprises some sort of ring or band that encircles either the front and rear panels of the tie immediately below the knot, or that, in some cases, replaces the knot completely.

In addition to apparatus for displaying an ornament on a necktie, other hardware from the haberdashery arts may be relevant. This hardware includes various apparatus used for spreading the front panel of the tie or for retaining the knot of the tie in a desired position with respect to a shirt collar.

BRIEF SUMMARY OF THE INVENTION

A preferred embodiment of the invention comprises a support, foundation, finding, holder or platform piece for an ornament to be displayed below a necktie knot. This foundation is preferably shaped and sized as a stylized triangle or trapezoid to fit into the folds of the necktie knot. It is preferably formed from a thin sheet of material having the surface shape of a necktie knot so that it does not change the shape of the knot when worn. The preferred foundation comprises two or more legs extending upwardly from a base portion adjacent which the ornament, or other item to be displayed, is attached to the foundation. These legs preferably extend laterally far enough to prohibit the foundation from falling through the knot. The ornament may be attached to the foundation by any of a number of fixation methods and, when worn, protrudes or drops below the knot into a visible position.

One of the features of a preferred embodiment of the invention is that it is capable of displaying an ornament of any shape, size or material on the face of the worn necktie, front and center, just below the knot.

An advantage of using the knot of the necktie to hold a support of a design is that there is no damage to the material of the tie, such as is caused by the use of prior art tie pins, which create holes, and prior art tie bars, which abrade the material.

Another advantage of a preferred embodiment of the invention is that it provides a support, foundation or platform that is invisible when worn because it is slipped into the outer fold-over in necktie knot.

Although it is believed that the foregoing rather broad recital of features and technical advantages may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed herein as a basis for designing other arrangements for carrying out the same purposes of the present invention. Those skilled in the art will realize that such equivalent constructions are within the spirit and scope of the invention in its broadest form. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 2:
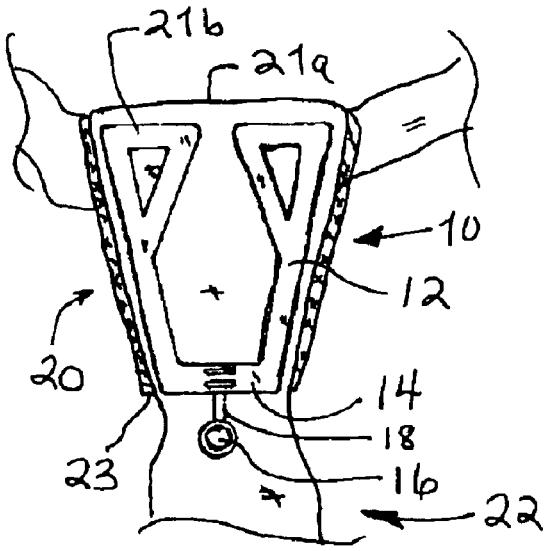
FIG. 2 is a front view of a necktie ornament holder disposed within a necktie knot from which a front portion has been cut away for clarity of presentation.
Figure 1:
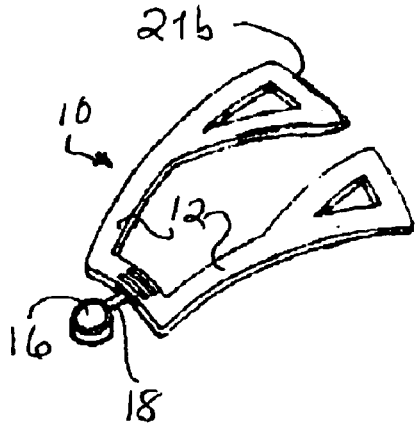
FIG. 1 is a perspective elevational view of a necktie ornament holder of the invention.
Figure 3:
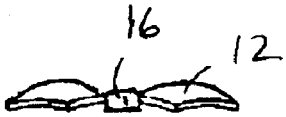
FIG. 3 is a bottom view of a necktie ornament holder.
Figure 4:
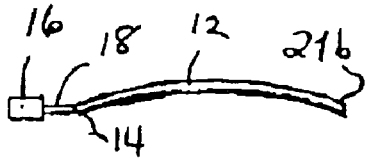
FIG. 4 is a right side elevational view of a necktie ornament holder, the left side view being a mirror image thereof.
Figure 5:
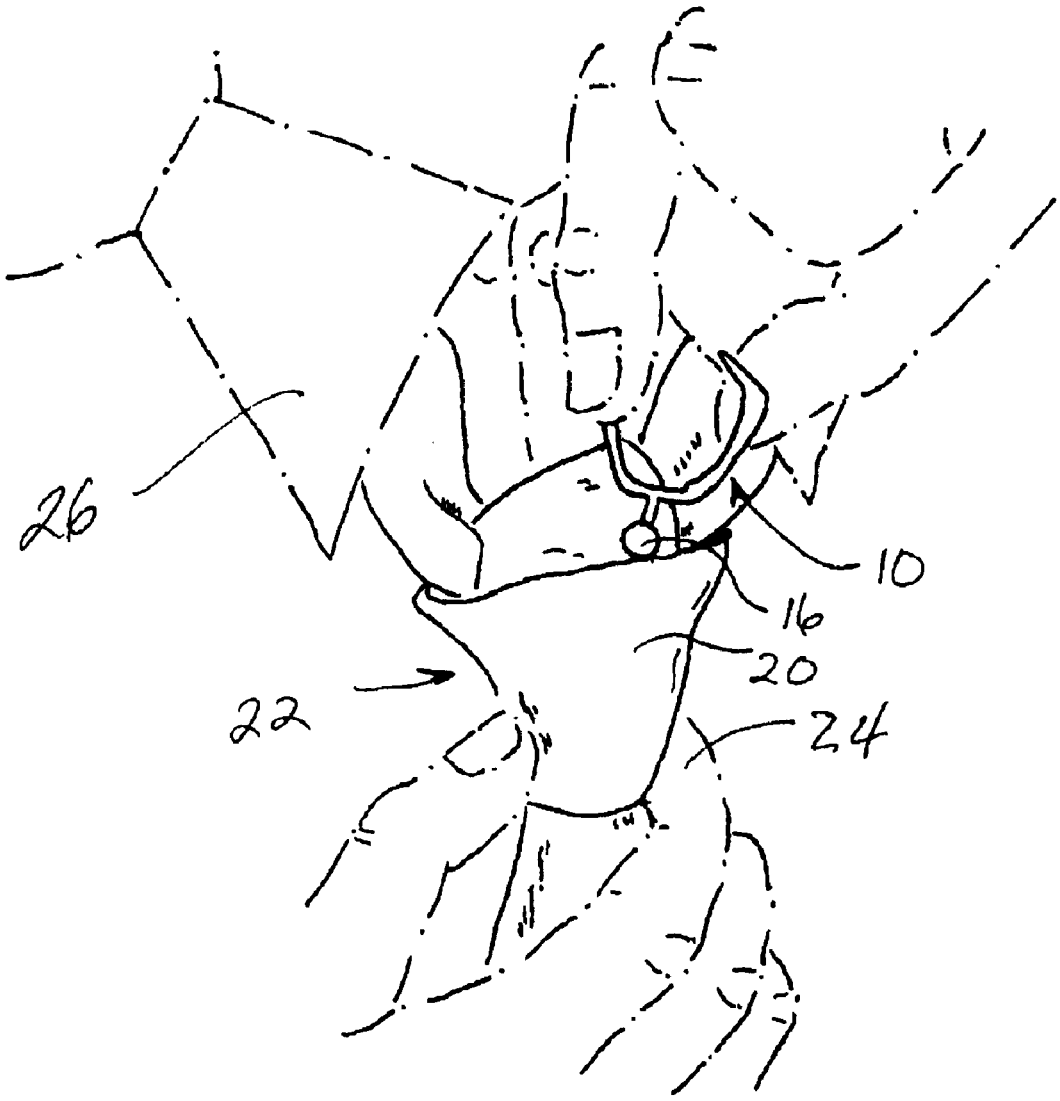
FIG. 5 is an elevational view depicting a person inserting a necktie ornament holder of the invention into a partially tied knot of a necktie.

In studying this Detailed Description, the reader may be aided by noting definitions of certain words and phrases used herein. Wherever those definitions are provided, the reader should understand that in many, if not most instances, such definitions apply to prior, as well as future uses of such defined words and phrases. At the outset of this Description, one may note that the terms "include" and "comprise," as well as derivatives thereof, mean inclusion without limitation; the term "or," is inclusive, meaning and/or; the terms 'holder', 'foundation' and 'finding' are generally equivalent in the jewelry arts; the verbs 'dress' and 'set', as is conventional in the knot-tying arts, denote steps of removing slack from a partially tied knot and fully tightening it; and the terms 'free end' or 'front panel' of the necktie are used interchangeably.

A preferred necktie ornament holder or foundation 10 comprises at least two leg portions 12 extending away from a base portion 14 or other common point and diverging as they become more distal from the base so as to provide an upper end 21*b* of the holder 10 that is wider than the base. An ornament may be attached to a suitable arm 18 or other linkage that extends away from the base 14 in a direction opposite to that of the legs 12.

As depicted in FIG. 2, the foundation 10 fits into a knot 20 of a necktie 22 in a generally vertical attitude in which the base portion 14 is adjacent, and preferably enclosed within, the bottom of the knot 20. As is conventional in necktie knots, the upper end 21 of the knot 20 is wider than the lower end 23 and a free end of the necktie extends downwardly from the upper end of the knot. A portion of the free end of the necktie that is enclosed within the knot is disposed behind a front portion of the knot, which is cut away to show the foundation or holder 10 in the depiction of FIG. 2. The holder 10 also has an upper end wider than the lower end of the knot so that it stays within the knot after being inserted therein to from the top of the knot before the knot is dressed by a user and set into its normal position adjacent a shirt collar 26.

Although the preferred embodiment of the holder 10 comprises a base portion 14 extending laterally on either side of a midpoint thereof, it will be recognized that one could equally well make a holder of the invention having a V shape—i.e., having a base of zero extent and having the ornament mounting link 18 attached at the apex of the V.

The preferred holder 10 comprises two leg portions 12, each of which is curved about an axis that is horizontal when the holder 10 is retained within a necktie knot 20. This choice of shape allows the holder to aid in maintaining a pleasingly convex profile of the front face of the knot. In one particular preferred embodiment, the foundation 10 is die cut from a one millimeter thick sheet of a titanium alloy.

As previously noted, the ornament 16 may be attached to the link 18 by any of a number of fixation methods, and the link may comprise any of a corresponding variety of suitable shapes for receiving the ornament. For example, the foundation may be sold to a retail jeweler in a configuration having a link with a set of prongs at the end distal from the base so that the jeweler can mount a suitable gem within the prong set as is conventional. Alternately, the ornament may be connected to the link by being glued to a suitable backing element or mounted within a suitable housing. If the ornament is a medallion, rather than a gem, one may elect to use a chain having a split terminal link, and then fitting the split terminal link into a through hole in the rim of the medallion. All these, and many other fixation methods are known in the jewelry art for attaching an ornament to the foundation and are to be included within the spirit and scope of the present invention.

It will be recognized that the foundation 10 could have a range of other shapes while still providing the desired ornamental support function. Although two legs are sufficient to ensure that the holder 10 stays within the knot 20 and does not fall therefrom, additional legs could be provided if, for example, one wished offer additional support to the front face of the knot. In fact, the preferred generally triangular or trapezoidal configuration of the holder 10 could be provided by an appropriately shaped sheet of material that was not bifurcated to form legs at all. Moreover, although preferred embodiment provides a relatively stiff foundation, one could choose to make the foundation of the invention using flexible legs formed from a suitable springy wire to ensure that both sides of the foundation pressed against the internal surfaces of the knot in order to more securely retain the foundation within the knot.

When the holder of the invention is worn in a necktie, the ornament 16 and a portion of the mounting link 18 are visible, but the rest of the apparatus is preferably concealed within the necktie knot. Although the link 18 is depicted in the drawing as being a straight, solid piece of material that is several millimeters long, those skilled in the jewelry arts will recognize that many other shapes, such as chains, may be used to add to the decorative features of the invention. Moreover, it will be recognized that the ornament may be connected to the link by any of a wide number of means known to the jewelry arts and selected to be appropriate to whatever ornament is to be displayed.

Those skilled in the haberdashery arts will recognized that the optimum size of the holder 10 may be selected to accord both with different manufacturing techniques and with the sort of knot that is to be used. In a particular preferred embodiment that has worked well with conventional necktie knots of the four-in-hand, half Windsor and Windsor varieties, the legs 12 extended upwardly some twenty five millimeters from the base 14 and encompassed a total width, at the widest part, distal from the base, of about twenty millimeters.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. In combination, a necktie and an ornament holder for displaying an ornament below a knot in the necktie, the knot having an upper end, a lower end, and a front panel, the ornament holder comprising:

a base portion narrower than the upper end of the knot and an upper end wider than the lower end of the knot; the ornament holder inserted into the knot from the upper end thereof so as to be disposed in front of a free end of the necktie;

the ornament holder further comprising a link portion for attaching the ornament thereto, the link portion extending downwardly from the base portion so that at least a portion of the link portion is disposed below the lower end of the knot, and so that all other portions of the ornament holder are concealed between the front panel of the knot and the free end of the necktie.

2. The combination of claim 1 wherein the ornament holder comprises two legs extending upwardly from the base and diverging from each other so as to provide an upper end of the holder that is wider than the base thereof.

3. The combination of claim 1 wherein the ornament holder comprises two legs extending upwardly from the base, each of the legs curved about a horizontal axis lying in a plane of the free end of the necktie.

4. The combination of claim 1 wherein the ornament holder is formed from a sheet of material and wherein the base of the ornament holder has a width selected to match a width of the lower end of the knot.

5. The combination of claim 1 wherein the lower end of the knot is wider than the upper end thereof and wherein the knot is one of a four-in-hand, half Windsor, and Windsor knot.

6. The combination of claim 1 wherein the link comprises a rigid arm.

7. The combination of claim 1 wherein the link comprises a chain.

8. A method of displaying an ornament below a knot of a necktie, the method comprising the steps of:

a) providing an ornament attached to a linking portion of an ornament holder having an upper end wider than a lower end of the knot, the linking portion disposed at a bottom of ornament holder;

b) partially tying the knot so that a free end of the necktie depends below the knot;

c) inserting the ornament through the knot from an upper end therefore so that the ornament depends below the lower end of the knot, so that both the ornament and ornament holder are disposed entirely in front of the free end of the necktie and so that at least a portion of the ornament holder is concealed behind a front panel of the knot; and d) dressing and setting the knot.

9. The method of claim 8 wherein the lower end of the knot is wider than the upper end thereof and wherein the knot is one of a four-in-hand, half Windsor, and Windsor knot.

* * * * *